US006834685B2

(12) United States Patent
Hannigan et al.

(10) Patent No.: US 6,834,685 B2
(45) Date of Patent: Dec. 28, 2004

(54) BI-MODULUS REINFORCEMENT FABRIC

(75) Inventors: Mark A. Hannigan, Wakefield, MA (US); Charles A. Howland, Temple, NH (US)

(73) Assignee: Warwick Mills, Inc., New Ipswich, NH (US)

( * ) Notice: Subject to any disclaimer, the term of this patent is extended or adjusted under 35 U.S.C. 154(b) by 271 days.

(21) Appl. No.: 10/223,281

(22) Filed: Aug. 16, 2002

(65) Prior Publication Data

US 2003/0111128 A1 Jun. 19, 2003

Related U.S. Application Data

(60) Provisional application No. 60/341,896, filed on Dec. 19, 2001.

(51) Int. Cl.[7] ..... D03D 15/00; D03D 13/00

(52) U.S. Cl. ..... 139/426 R; 139/420 A; 442/203; 442/217; 442/212

(58) Field of Search ..... 139/426 R, 420 A; 66/195, 202; 442/203, 208–210, 213, 217

(56) References Cited

U.S. PATENT DOCUMENTS

| | | | | |
|---|---|---|---|---|
| 4,106,967 A | | 8/1978 | Logan et al. | |
| 4,142,557 A | * | 3/1979 | Kositzke | 139/425 A |
| 4,157,101 A | | 6/1979 | Ross | |
| 4,238,260 A | | 12/1980 | Washkewicz | |
| 4,241,763 A | | 12/1980 | Antal et al. | |
| RE31,047 E | | 10/1982 | Ross | |
| 4,522,235 A | | 6/1985 | Kluss et al. | |
| 4,657,623 A | | 4/1987 | Wesch | |
| 4,759,388 A | | 7/1988 | Kiyama et al. | |
| 4,820,571 A | * | 4/1989 | Searfass | 442/189 |
| 4,844,969 A | * | 7/1989 | Chang | 5/186.1 |
| 5,270,113 A | | 12/1993 | Rebouillat | |
| 5,394,563 A | | 3/1995 | Doyle | |
| 5,401,564 A | * | 3/1995 | Lee et al. | 442/210 |
| 5,419,231 A | | 5/1995 | Earle, III et al. | |
| 5,513,683 A | | 5/1996 | Causa et al. | |
| 5,565,264 A | | 10/1996 | Howland | |
| 5,576,104 A | | 11/1996 | Causa et al. | |
| 5,755,558 A | | 5/1998 | Reinfelder et al. | |
| 5,837,623 A | | 11/1998 | Howland | |
| 5,958,804 A | * | 9/1999 | Brown et al. | 442/192 |
| 5,976,996 A | | 11/1999 | Howland | |
| 6,176,268 B1 | | 1/2001 | Hsich et al. | |
| 6,209,587 B1 | | 4/2001 | Hsich et al. | |
| 6,228,786 B1 | * | 5/2001 | Olry et al. | 442/205 |
| 6,261,675 B1 | * | 7/2001 | Hsiao et al. | 428/219 |
| 6,263,920 B1 | | 7/2001 | Hsich et al. | |
| 6,266,818 B1 | | 7/2001 | Howland et al. | |

* cited by examiner

*Primary Examiner*—John J. Calvert
*Assistant Examiner*—Robert H. Muromoto, Jr.
(74) *Attorney, Agent, or Firm*—Maine & Asmus

(57) ABSTRACT

A fabric system and manufacturing method for achieving higher fiber crimp in selected fibers to reduce initial fabric modulus (gain higher elongation) in the thread-line direction. The fabric system and method utilizes processing yarns of higher shrinkage than the product reinforcing yarns. The processing yarns are woven together with the reinforcing yarns in various patterns and combinations dependent on the desired fabric characteristics. The fabric is processed thermally or otherwise to impart crimp into the reinforcing yarns by the differential shrinkage of the processing yarns. By adjusting the ratio of reinforcing yarns to processing yarns, a unique set of characteristics in the fabric is created, specifically a lower modulus, higher initial elongation in the thread-line direction of the reinforcing yarn.

16 Claims, 2 Drawing Sheets

BI-MODULUS REINFORCEMENT FABRIC

This application relates and claims priority to U.S. application Ser. No. 60/341,896, filed Dec. 19, 2001 now abandoned.

FIELD OF INVENTION

The invention relates to fabric specifications combining fibers of different modulus with particular fabrication techniques to produce reinforcement fabrics of compound modulus characteristics.

BACKGROUND

Definitions:

Fiber: unit of matter, either natural or manufactured, that forms the basic element of fabrics or textile structures. The fiber is characterized as having a length of at least 100 times its diameter or width.

Fibrous web: a unit of material in web form containing fiber components such as a woven fabric, knit fabric, laid-yarn products and spun bonded products.

Composite fiber: fiber composed of more than one polymer/fiber type, combined by ply-twisting, entangling or other means.

Intimate blend fiber: a technique of mixing two or more dissimilar staple fibers in a very uniform mixture. Usually the stock is mixed before or at the picker.

Crimp: the difference in distance between two points on a fiber in a fabric and the same two points on the fiber after it has been removed from the fabric and straightened under a specified tension, expressed as a percentage of the distance between the two points as it lies in the fabric; may be imparted to the yarn by several yarn processing methods including twisting, texturizing, knit-deknit, stuffer box method, and yarn entangling; may be imparted to the yarn several fabric formation processes such as weaving, knitting, braiding, etc.

Modulus: the ratio of the change in stress or force per unit length to the change in strain expressed as a fraction of the original length or percentage elongation, after crimp has been removed.

Fiber modulus: modulus of fiber.

Fabric modulus: modulus of fabric along test axis (warp/fill/bias) after crimp is removed.

Fabric crimp modulus: modulus of a fabric while crimp is being removed from the fibers as the fabric is loaded; initial part of modulus curve before fibers are under axial tension; significantly lower modulus than fiber/fabric modulus.

Low load elongation (LLE): elongation range over which fabric crimp modulus is measured; typically elongation value is based on a load limit less than 5 pounds per lineal inch (5 pli).

Shrinkage—change in fiber length due to a process mechanism such as dry heat, steam heat or chemistry.

Shrinkage tension—tension fiber/fabric exerts in fiber axis while shrinkage is performed.

Shrinkage crimp—amount of crimp imparted in the fabric/fiber as a result of shrinkage.

Differential shrinkage—difference in shrinkage between process fiber and reinforcement fiber.

Composite fabric—woven, braided or knitted substrate comprised of more than one fiber type.

Modulus is a characteristic of a material representing how much load (stress) is required to achieve a certain level of stretch (strain). As a result, a low modulus material requires less force than a high modulus material to achieve a given amount of elongation.

The modulus of a material may be constant in a material throughout a range of elongation values or quite variable, particularly for elastomeric composites. Homogeneous, non-reinforced elastomeric materials are generally considered low modulus and are also isotropic, or have the same properties in all directions. Textile fibers are medium or high modulus materials relative to elastomers and are not isotropic but rather have very different properties in the thread line direction vs. the transverse direction of the fiber.

Knit textiles are typically low modulus structures in that they stretch easily and have very high elongation to break. As a result of the knit structure, however, they tend to be inefficient materials on a strength/weight basis and may not always provide reasonable limits of elongation desired for certain component applications such as high pressure hoses and diaphragms.

Woven textile fabrics are typically lower stretch materials and have a modulus that is dependent on the angle of load relative to the orientation of the fabric and fiber. The modulus of the fabric will range from slightly lower than the fiber modulus in the thread-line direction to a much lower modulus at a 45° bias angle. The lower modulus on the bias angle is attributed to the ability of the fibers in the fabric to re-orient as load is applied.

The fabric modulus in the bias direction is typically much lower than the fabric modulus along the thread-line. Typical hose and diaphragm reinforcement fabrics have a thread-line modulus of 100–500 pli (0.9%–5.0% elongation @ 5 pli). Alternatively, the bias modulus of these same fabrics (@ 45°) is reduced to <16–25 pli (20–30% @ 5 pli).

Referring to prior art FIG. 1, there is shown a graph comparing the moduli of standard reinforcement fabric in the fill (1) direction versus 45 degree bias (2) direction. At a given elongation, the fill (weft) oriented material exhibits a higher load due to relatively high fiber stiffness and low weaving crimp. The bias oriented material exhibits a lower load elongation based on combination of warp and fill (weft) crimp as well as the fiber rotation. The low load elongation characteristics are utilized to enhance fabric processing and product characteristics.

Fabric reinforced elastomeric composites have modulus properties greater than the fabric but are still variable in direction due to the nature of the fabric reinforcement. Often, fabric orientation is controlled in the manufacture of fiber reinforced elastomer composites to achieve specific characteristics in the composite product in one or more directions.

Examples of fabric reinforced elastomer composites include hoses, belts, diaphragms and tires. In each of these applications, greater low load elongation is required in the manufacture of these parts than is available in the fabric along the threadline of the fiber. A common solution is to cut the fabric at a bias angle (e.g. 45°) and orient the fabric in the manufacturing process in the lower modulus direction to aid in the formation, assembly or performance of the composite product.

The bias modulus of 16–25 pli is adequate for many reinforced rubber and elastomer products. However, there remain problems with the prior art. The cost and productivity impact of utilizing fabrics at a bias angle, are non-trivial. Bias cutting the fabric requires special equipment, extra labor and increases waste costs of the process. Similar issues exist in apparel, glove and footwear manufacture.

What is needed is a fabric design which provides a lower fabric crimp modulus to deliver low load elongation in the thread-line direction greater than the 5% upper limit inherent in standard fabrics.

SUMMARY OF THE INVENTION

The invention encompasses a fabric system and manufacturing method that allows woven fabric to achieve a lower fabric crimp modulus (higher elongation) in the thread-line direction. The fabric system and method utilizes processing yarns of higher shrinkage than the product reinforcing yarns. The processing yarns are woven together with the reinforcing yarns in various patterns and combinations dependent on the desired fabric characteristics. The fabric is subsequently processed thermally to enable crimp to be imparted into the reinforcing yarns by the differential shrinkage of the processing yarns. By adjusting the ratio of reinforcing yarns to processing yarns, a unique set of characteristics in the fabric can be created, specifically lower modulus/higher initial elongation in the threadline direction of the reinforcing yarn.

These characteristics can be referred to as a compound fabric modulus, and the web or fabric referred to as a bi-modulus fabric; where there is a beneficially lower first modules low load elongation characteristic coupled with a beneficially higher second modules fabric stress limit, a combination not otherwise attainable along a threadline.

It is therefore among the objects of the invention to provide a product and a method for making the product from two different yarn types; where the product is a fibrous web, fabric, fabric-reinforced elastomeric product or part, component, or related article that benefits from having a compound fabric modulus along at least one thread line of the fabric weave. The feature in the fabric may be of benefit in the manufacture and/or the performance of the fabric, component or part.

DETAILED DESCRIPTION OF THE INVENTION

Several fibers have very low shrinkage/shrinkage tension at elevated temperatures (from 150 to 500 F., <5%). Examples include:

a) acrylic
b) Liquid Crystal Polymer (Vectran™)
c) Low shrink polyester (Trevira™)
d) Low shrink aramid (Nylon™)
e) Melamine (Basofil™)
f) Meta-aramid (Nomex™, Conex™)
g) Para-aramid (Kevlar™, Twaron™, Technora™)
h) UHMW Polyethylene (Spectra™, Dyneema™)

Applicant makes no claim to the trademarks referenced here and elsewhere; references are provided as examples of brand names well-known in the industry, which are associated with the related materials.

Other fibers have very high shrinkage/shrinkage tension at normal processing temperatures (150–400 F., >15%). Examples include:

a) Nylon
b) Polyester (T52 Dacron™)
c) Polypropylene

Although the shrinkage process is the preferred embodiment for manipulating the processing yarn as described, non-thermal mechanisms may be used to produce this effect as well, including but not limited to chemical treatments, elastic contraction of elastomeric yarns or fiber filling or fiber felting of natural cotton or wool fibers. In both cases, these yarns act as the processing yarn imparting crimp in the reinforcing yarn by their reduction in length.

Figure 1:
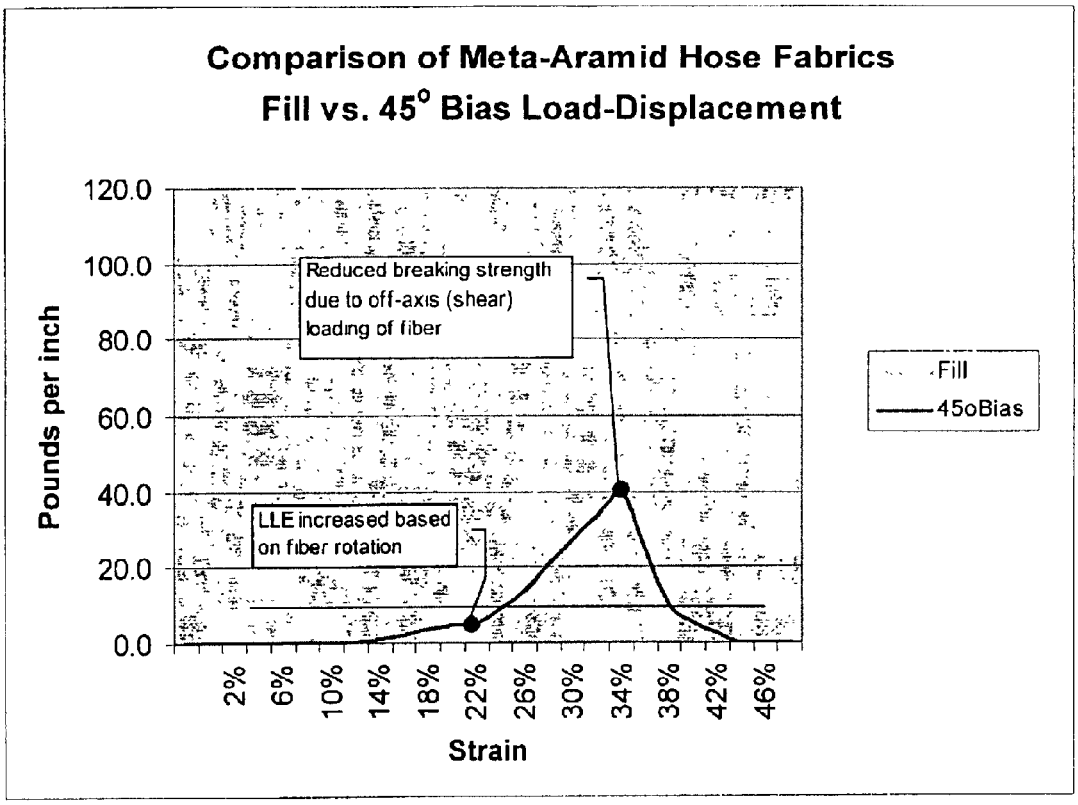
Figure 1 (PRIOR ART)
FIG. 1 is a graph of the comparative moduli of standard reinforcement fabric in the fill direction versus 45 degree bias direction.
Figure 2:
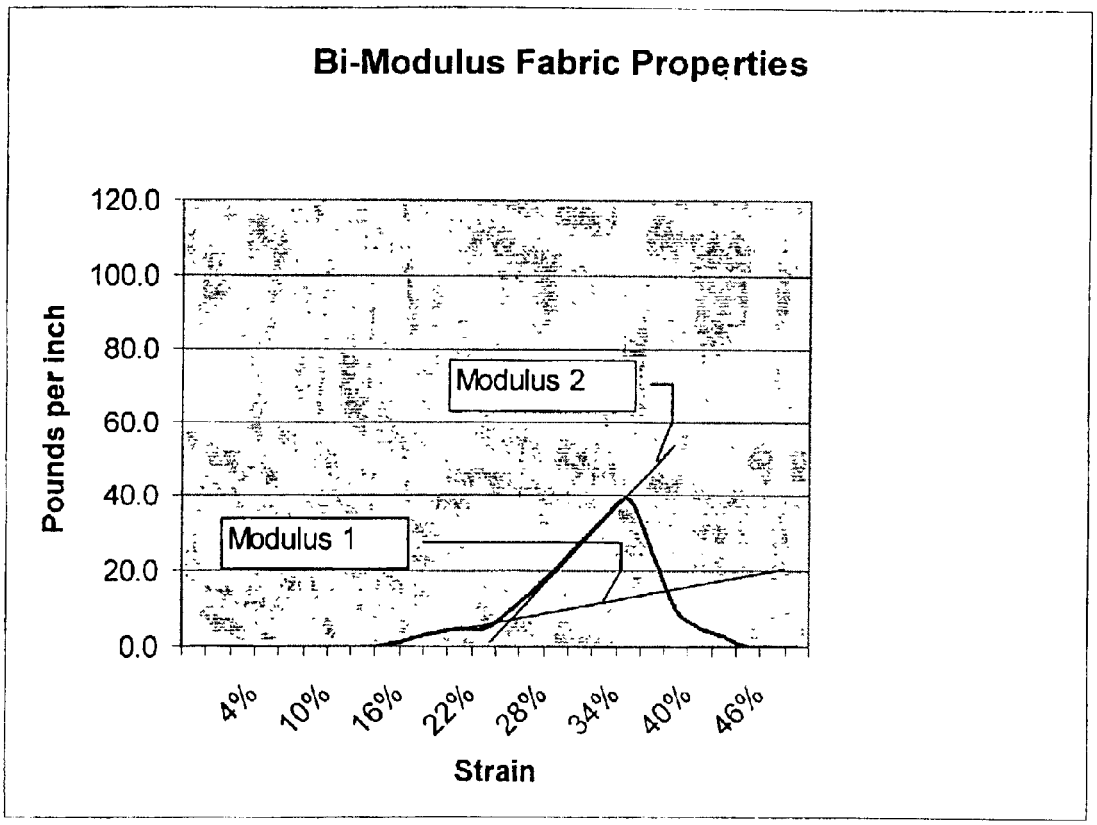
FIG. 2 is a graph of the load-elongation characteristics for a representative bi-modulus fabric of the invention.

Referring to FIG. 2, there is shown a graph of the load-elongation characteristics for a representative bi-modulus fabric of the invention. Low load elongation characteristic similar to the bias results shown in prior art FIG. 1 are achieved in this new fabric in the filling direction, thus eliminating the need to bias cut the fabric to achieve extra stretch.

The compound fabric modulus or bi-modulus fabric properties of the invention, as exhibited in FIG. 2, extend to and include a fabric that has three principle characteristics. There is more than one distinct fabric modulus beyond at least 5% and preferably beyond 10% elongation in at least one fiber direction. There is exhibited relatively high elongation in the fiber direction, at least 5% and preferably greater than 10%, at low load of either 5–10 pounds per linear inch or about 25% of the breaking strength or stress limit of the fabric in the fiber direction, whichever is greater. And it is constructed of yarn which is not crimped by special means other than by typical twisting or spinning prior to weaving or knitting, in other words, the yarn did not need to be subjected to knit-deknit, gear crimping, stuffer box crimping, or other such pre-weaving conditioning.

The application for reinforcement fabrics with controlled bi-modulus properties with higher low load elongation in one or more fiber directions includes fiber reinforced elastomer materials such as hoses, diaphragms, belts, seals, gaskets, and tires, as well as other flexible composite materials for use in spinnaker sails, inflated structures, inflatable craft, storage tanks, floatation devices, and devices intended to reduce shock and vibration. In addition there is broad application in apparel goods including outerwear, innerwear, glove and footwear. This disclosure is directed to a material system that can be tailored and applied to any of these and similar products. This disclosure is intended to cover the use of this material system in these and related products and hybrids. This disclosure is intended to include the integration of these fabrics into these products by means of stitching, adhesives, lamination, calendaring, mechanical assembly, molding by pressure and/or heat in single part and/or multipart molds or mandrels or by autoclaving or other known means. The inventors are well aware of the application of these technologies to produce the listed products.

The invention in all embodiments contains a fabric with a least one fiber direction having the bi-modulus properties defined above. This direction is intended as the primary loading axis where additional stretch is desirable for manufacturing of the product and/or in the product itself. To maximize stretch retention, the cross machine direction (CM) of the fabric is the preferred direction to contain the bi-modulus properties. This embodiment preserves the higher stretch in the CM direction, while allowing processing in the machine direction. It is very desirable to have bi-modulus properties in the MD as well as long as it can be retained through processing as it lends to additional manufacturing simplification for some products.

The principles of the invention have been put into practice with several fabrics using greater than 10% processing fiber (P-Fiber) by weight in the bi-modulus direction. A preferred embodiment includes a woven fabric with warp material made of a low shrink spun meta-aramid fiber woven with weft yarns where 75% of the weft fiber by weight is a spun meta-aramid fiber and 25% of the weft fiber by weight is high shrinkage filament nylon fiber. Anyone skilled in the art of weaving and informed by this disclosure can create such a fabrics. Fabric finishing includes a minimum of one heat setting pass to create the differential crimp by differential shrinkage of the weft fibers and may or may not include a scouring process to clean the fabric and may or may not include the application of adhesion promoters such as silanes or RFLs or other coatings determined appropriate to the application. Anyone skilled in the art of finishing and informed by this disclosure can create such fabric properties with standard finishing equipment.

The application of the preferred embodiment to mandrel wrapped hose manufacturing is significant for several reasons, particularly for hose parts that have sections of differential diameters. While non-reinforced rubber parts can easily deform to slide over the various geometric sections of a mandrel, reinforced rubber parts need the reinforcement fabric to expand in these areas to allow for part removal from the mandrel as part of the manufacturing process. The bi-modulus fabric allows for this expansion. The extent of the allowable expansion is determinable using an appropriate percentage of processing fiber vs. reinforcing fibers based on hose strength requirements and cost parameters.

For sheet molded rubber parts which are molded, stamped or drawn by other process methods to a part depth greater than 15% of the diameter of the part (or the smallest dimension in the initial plane direction of the sheet), a bi-modulus reinforcement fabric allows for deeper parts to be fabricated with fibers which cannot be reliably processed by a pre-crimping method including fibers such as spun fibers or high modulus fibers, including para-aramid, UHMW or liquid crystal polymer fibers.

For molded rubber parts using a fabric pre-form, such as deep draw diaphragms, where greater part depth is desired relative to sheet molded parts, a bi-modulus fabric can be used to increase part depth further by providing extra fabric elongation in the MD and/or CM direction as compared to standard woven materials while providing significant improvement in part strength as compared to knit fabrics.

Also, a fabric reinforcement made with high modulus fibers such as para-aramid (Kevlar™), liquid crystal polymer (Vectran™), UMW polyethylene (Spectra™) or equivalent fibers can be produced with processing fibers to create a bi-modulus reinforcement which allows for an increase in pre-form depth over what was previously limited by the lack of stretch in the fabric due to the high modulus fibers.

Other and various embodiments within the scope of the invention and the appended claims will be apparent to those skilled in the art from the description and figures provided. For example, there is within the scope of the invention, a fibrous web with a compound fabric modulus in at least one of warp and fill directions consisting of at least a first yarn type and a second yarn type woven together in at least one of the warp and fill directions, where the second yarn type has a higher fiber modulus and greater fiber shrinkage crimp than the first yarn type imparted by processing of the fibrous web.

The compound modulus of the fibrous web consists of a first modulus low load elongation of greater than 5% @ 5 pli, and a second modulus fibrous web stress limit of at least 15 pli. The compound modulus may have a first modulus low load elongation of greater than 10% @ the greater of 5 pli or 25% of the fibrous web stress limit, and a second modulus fibrous web stress limit of at least 15 pli. The first yarn type may be greater than 10% by weight of yarn used in the selected direction. The second yarn type may consist of fibers from among the group of fibers consisting of para-aramid, liquid crystal polymer, and UMW polyethylene.

As another example, there is a fibrous web with a compound fabric modulus in each of both warp and fill directions consisting of at least a first yarn type and a second yarn type woven together in each direction, where the second yarn type has a higher fiber modulus and greater fiber shrinkage crimp after processing than the first yarn type, and where the compound modulus in each direction has a first modulus low load elongation of greater than 5% @ 5 pli, and a second modulus fibrous web stress limit of at least 15 pli.

As yet another example, there is a woven fabric with a compound fabric modulus in the weft direction consisting of a warp material woven with weft yarns, where the weft yarns consist of greater than 10% of weft fiber by weight of a high shrinkage filament nylon fiber and less than 90% of weft fiber by weight of an aramid type fiber such as a spun meta-aramid fiber, and the woven fabric has been thermally processed for shrinkage of the nylon fibers. The nylon fibers may be 25% by weight, and the aramid type fiber may be 75%.

As a further example, there is a woven fabric with a compound modulus in the CM (cross machine, weft, or fill) direction, consisting of one yarn type in the MD (warp or machine direction) and at least two yarn types in the CM direction, the second yarn type of the two yarn types having a higher fiber modulus and greater fiber shrinkage crimp, due to having a lower fiber shrinkage, than the first yarn type after shrinkage processing, and the compound moduli comprising a first modulus low load elongation of greater than 5% @ 5 pli, and a second modulus fabric stress limit of at least 15 pli.

Another example of the invention is a fiber reinforced elastomeric material consisting of a fibrous web with a compound fabric modulus in at least one of warp and fill directions, where the fibrous web is made up of at least a first yarn type and a second yarn type woven together in a common one of the two directions, and the second yarn type has a higher fiber modulus and greater shrinkage crimp after shrinkage processing than the first yarn type.

The compound modulus may have a first modulus low load elongation of greater than 5% @ 5 pli, and a second modulus fabric stress limit of at least 15 pli. The second yarn type made use fibers from among the group of fibers consisting of para-aramid, liquid crystal polymer, and UMW polyethylene fibers.

The invention contemplates, discloses and claims methods as well as products. For example, there is a method for making a woven fabric with a compound modulus in at least one of the warp and weft directions, consisting of the steps of weaving a fibrous web with at least two yarn types in at least one of the warp and weft directions, where the two yarn types have different fiber shrinkage characteristics and different fiber moduli, and then processing the fibrous web for fiber shrinkage so as to achieve the shrinkage differential between the two yarn types.

The fiber shrinkage characteristics may be thermal, the second yarn type have a higher fiber modulus and lower thermal shrinkage characteristic than the first yarn, and the processing may be thermal processing at a temperature greater than 100 F. The at least one of warp and weft directions can be both warp and weft directions. The second yarn type may have a fiber modulus of at least 100 pli and a thermal fiber shrinkage characteristic of less than 5%, and the first yarn type may have a fiber modulus low load elongation of greater than 5% @ 5 pli and a thermal fiber shrinkage characteristic of greater than 15%. Furthermore, the compound modulus of the fibrous web after the step of thermal processing may have a first modulus low load elongation of at least 5% @ 5 pli, and a second modulus fabric stress limit of at least 15 pli. The yarn type may come from the group consisting of filament, spun, and intimate blend yarns. The weaving may be of a plain, basket, or pattern weave construction.

Another method for making a woven fabric of a plain, basket or pattern weave with a compound modulus in the weft direction includes the steps of weaving two or more yarn types having uniform thermal fiber shrinkage characteristics in the warp direction with two or more yarn types having different thermal fiber shrinkage characteristics and different fiber moduli into a woven web; and processing the woven web at a temperature greater than 100 F. until a differential fiber shrinkage is obtained in the weft direction.

Other and various embodiments and equivalent constructions within the scope of the invention and the claims that follow will be apparent to those skilled in the art from the specifications and attached figures.

We claim:

1. A fibrous web with a compound fabric modulus in at least one of warp and fill directions comprising at least a first yarn type and a second yarn type woven together in at least one of said warp and fill directions, said second yarn type having a higher fiber modulus and greater fiber shrinkage crimp than said first yarn type.

2. The fibrous web of claim 1, said compound modulus comprising a first modulus low load elongation of greater than 5% @ 5 pli, and a second modulus fibrous web stress limit of at least 15 pli.

3. The fibrous web of claim 1, said compound modulus comprising a first modulus low load elongation of greater than 10% @ the greater of 5 pli or 25% of the fibrous web stress limit, and a second modulus fibrous web stress limit of at least 15 pli.

4. The fibrous web of claim 1, said first yarn type comprising greater than 10% by weight of yarn used in selected said direction.

5. The fibrous web of claim 1, said second yarn type comprising fibers from among the group of fibers consisting of para-aramid, liquid crystal polymer, and UMW polyethylene.

6. A woven fabric with a compound modulus in the CM direction comprising one yarn type in the MD direction and at least two yarn types in the CM direction, the second yarn type of said two yarn types having a higher fiber modulus and greater fiber shrinkage crimp than the first yarn type of said two yarn types, said compound moduli comprising a first modulus low load elongation of greater than 5% @ 5 pli, and a second modulus fabric stress limit of at least 15 pli.

7. A fiber reinforced elastomeric material comprising a fibrous web with a compound fabric modulus in at least one of warp and fill directions, said fibrous web comprising at least a first yarn type and a second yarn type woven together in a common direction, said second yarn type having a higher fiber modulus and greater shrinkage crimp than said first yarn type.

8. The fiber reinforced elastomeric material of claim 7, said compound modulus comprising a first modulus low load elongation of greater than 5% @ 5 pli, and a second modulus fabric stress limit of at least 15 pli.

9. The fiber reinforced elastomeric material of claim 7, said second yarn type comprising fibers from among the group of fibers consisting of para-aramid, liquid crystal polymer, and UMW polyethylene.

10. A method for making a woven fabric with a compound modulus in at least one of warp and weft directions comprising the steps of:

weaving a fibrous web with at least two yarn types in at least one of said warp and weft directions, said two yarn types having different fiber shrinkage characteristics and different fiber moduli, and processing said fibrous web for fiber shrinkage.

11. The method of claim 10, said fiber shrinkage characteristics being thermal, the second yarn type of said two yarn types having a higher said fiber modulus and lower said thermal shrinkage characteristic than the first yarn type of said two yarn types, said step of processing comprising thermal processing at a temperature greater than 100 F.

12. The method of claim 10, said at least one of warp and weft directions comprising both warp and waft directions.

13. The method of claim 11, said second yarn type having a fiber modulus of at least 100 pli and a thermal fiber shrinkage characteristic of less than 5%, said first yarn type having a fiber modulus low load elongation of greater than 5% @ 5 pli and a thermal fiber shrinkage characteristic of greater than 15%.

14. The method of claim 13, said compound modulus of said fibrous web after said step of thermal processing comprising a first modulus low load elongation of at least 5% @ 5 pli, and a second modulus fabric stress limit of at least 15 pli.

15. The method of claim 14, said yarn type comprising at least one from the group consisting of filament, spun, and intimate blend yarns.

16. The method of claim 15, said step of weaving comprising weaving a construction from the group of weave constructions consisting of plain, basket, and pattern weaves.

* * * * *